US006199394B1

(12) United States Patent
Maeda

(10) Patent No.: US 6,199,394 B1
(45) **Date of Patent: *Mar. 13, 2001**

(54) AIR CONDITIONING SYSTEM

(75) Inventor: Kensaku Maeda, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/331,786

(22) PCT Filed: Dec. 24, 1997

(86) PCT No.: PCT/JP97/04779

§ 371 Date: Jun. 25, 1999

§ 102(e) Date: Jun. 25, 1999

(87) PCT Pub. No.: WO98/29694

PCT Pub. Date: Jul. 9, 1998

(30) Foreign Application Priority Data

Dec. 27, 1996 (JP) ..... 8-358240
Jan. 21, 1997 (JP) ..... 9-021981

(51) Int. Cl.[7] ..... F25D 23/00
(52) U.S. Cl. ..... 62/271; 62/94
(58) Field of Search ..... 62/271, 94, 238.6, 62/238.3

(56) References Cited

U.S. PATENT DOCUMENTS 4,887,437 12/1989 Fenton et al. .
5,176,005 * 1/1993 Kaplan ..... 62/94
5,325,676 7/1994 Meckler .
5,364,455 11/1994 Komarneni et al. .
5,448,895 9/1995 Coellner et al. .
5,551,245 * 9/1996 Calton et al. ..... 62/271 X
5,579,647 12/1996 Calton et al. .
5,661,983 * 9/1997 Groten et al. ..... 62/271
5,718,122 2/1998 Maeda .
5,758,509 6/1998 Maeda .
5,761,923 6/1998 Maeda .
5,761,925 6/1998 Maeda .
5,791,153 * 8/1998 Belding et al. ..... 623/271 X
5,791,157 8/1998 Maeda .
5,816,065 10/1998 Maeda .
5,931,015 8/1999 Maeda .
5,943,874 8/1999 Maeda .
5,950,447 9/1999 Maeda et al. .

FOREIGN PATENT DOCUMENTS 2 357 828 2/1978 (FR) .
WO 96 23185 8/1996 (WO) .

* cited by examiner

*Primary Examiner*—Corrine McDermott
*Assistant Examiner*—Chen-Wen Jiang
(74) *Attorney, Agent, or Firm*—Armstrong, Westerman, Hattori, McLeland & Naughton

(57) ABSTRACT

An air conditioning system for processing recirculated room air while admitting outdoor air. The air condition system includes a first air conditioning apparatus for processing and admitting an outdoor air into an indoor space and a second air conditioning apparatus for processing a sensible heat load. The first air conditioning apparatus includes air passages, desiccant device, heat pump device, and enthalpy heat exchanger. The second air conditioning apparatus is arranged so that the heat pump device can process the sensible heat load within the conditioning space.

14 Claims, 9 Drawing Sheets

AIR CONDITIONING SYSTEM

TECHNICAL FIELD

The present invention relates to air conditioning systems, and relates in particular to a combined air conditioning unit combining a room air conditioner to process recirculated room air and a ventilation air conditioner to process and admit outdoor air into indoors.

BACKGROUND ART

FIG. 8 shows an example of a conventional air conditioning system. This is a combination system in which an indoor air conditioner unit 3 for processing room air by recirculating the indoor air is combined with a ventilation air conditioner 11 to process outdoor air and admit processed outdoor air into indoors. The system is based on an enthalpy heat exchanger, and undertakes heat exchange processes for both humidity and sensible heat in outdoor air and indoor air. Processing load on the air conditioner generated in the conditioned space is extracted by a heat pump system and discharged to outdoors.

The operation of such a system will be explained with reference to a psychrometric chart shown in FIG. 9. During a cooling period, outdoor air (at a state K) and indoor air (at a state Q) exchange enthalpy and outdoor air reaches a state L and indoor air reaches a state T, and respectively become a supply air to indoor space and an exhaust air to be discharged to outdoors. Enthalpy exchange efficiency for this process is as low in the currently available products as in a range of 60~70%, so that an enthalpy difference AH is produced between the supply air (at a state L) and room air (at a state Q). The result is that air having excess humidity (i.e., difference in moisture content, $\Delta X$) is supplied to the room so as to introduce moisture corresponding to 30~40% of humidity ratio difference between untreated outdoor air and indoor air. This moisture must be removed by the air conditioning system, by cooling the indoor air to 5~10° C., which is lower than its dew point (15~16° C.).

Of the air processing loads on the air conditioner based on an enthalpy heat exchanger, the latent heat load required for dehumidification is about 10~15% of the total load and the remaining 85~90% is a sensible heat load. This sensible heat load can be removed at about 15~20° C. without cooling the air temperature to the dew point. However, in the conventional systems, because the admitted outdoor air is mixed with the indoor air and the whole air has to be processed, the latent heat is removed only by cooling the air to well below the dew point, to about 10° C. Therefore, the temperature difference (temperature lift) between the evaporator temperature and the condenser temperature in the air conditioner needs to be set the same as in a case when not using the enthalpy heat exchanger, meaning that although the conditioning load on the air conditioner can be reduced, the temperature lift for pumping up the heat cannot be reduced.

It can be seen in that, in the conventional systems, a large amount of temperature lift is necessary for pumping and discharging the heat, therefore, energy consumption in the heat pump for removing sensible heat has been high and wasteful. Also, the facility becomes cumbersome because of the necessity of providing a drain to discharge condensed moisture.

DISCLOSURE OF INVENTION

It is an object of the present invention to provide a high efficiency air conditioning apparatus and an air processing system incorporating such an air conditioning apparatus to enable energy conservation by preventing sensible heat as well as latent heat from outdoor air.

The object has been achieved in an air conditioning apparatus comprising: a first air passage for directing air from a first space to a second space, and a second air passage for directing air from the second space to the first space; a desiccant device alternatingly communicating with the first air passage and with the second air passage so as to perform a regeneration process in the first air passage and to perform a dehumidification process in the second air passage; a heat pump device having a high temperature heat source for heating air flowing through the first air passage and a low temperature heat source for cooling air flowing through the second air passage; and an enthalpy heat exchanger for performing enthalpy heat exchange between air in the first and second air passages; wherein, air flowing in the first air passage exchanges heat in the enthalpy heat exchanger with air flowing in the second air passage, is then heated by contacting the high temperature heat source, and flows into the desiccant device so as to desorb and regenerate the desiccant device and flows into the second space, and wherein, air flowing in the second air passage exchanges heat in the enthalpy heat exchanger with air flowing in the first air passage, is then dehumidified by passing through the desiccant device, is cooled by contacting the low temperature heat source and flows into the first space.

Accordingly, for a cooling operation, the conditioning space to be air conditioned becomes the first space and the outdoor space becomes the second space for supplying outdoor air into indoor space through the second air passage. Outdoor air admitted from the second air passage is processed to reduce its humidity ratio compared with that for the indoor air, therefore, excess moisture is not brought into indoors so that there is no need to be dehumidified by the indoor air conditioner. Also, reduction of moisture content in the supply air means that temperature lift for driving the heating/cooling cycles of the indoor air conditioner can be lowered to achieve a significant energy conservation. Because the indoor air conditioner does not have to dehumidify ventilation air, there is no need for a drain to remove condensate.

In the above apparatus, the heat pump device may be a vapor compression type heat pump or an absorption type heat pump.

During a cooling operation, the first space becomes an indoor conditioning space and the second space becomes an outdoor space. During a heating operation, the first space becomes an outdoor space and the second space becomes an indoor conditioning space.

In the apparatus presented above, the ventilation air conditioning unit can be used in combination with an indoor air conditioning unit which performs cooling on a sensible heat load in the conditioning space. In such a system, during a cooling operation, outdoor air is led into the ventilation air conditioning unit so that the humidity ratio of the incoming air is lower than that of the air in the indoor conditioning space. Therefore, excess moisture is not brought into indoors, and the inside air conditioning units do not need to dehumidify the inside air. Temperature lift to drive the inside conditioners can be lowered and a significant energy saving can be achieved. Because there is no need to dehumidify, no drain is needed to remove condensate.

The apparatus may be arranged so that the heat pump device processes a sensible heat cooling load in a conditioning space. In such a system, sensible heat is recovered during the cooling operation to utilize the recovered heat in moisture removal and regeneration of desiccant material. Regenerated desiccant works more efficiently, and coupled with sensible heat recovery, contributes to conservation of energy and high operating efficiency.

The object has also been achieved in an air conditioning apparatus comprising: a first air passage for directing air from a first space to a second, and a second air passage for directing air from the second space to the first space; an enthalpy heat exchanger for exchanging heat between air flowing in the first air passage and air flowing in the second air passage; a heat pump device having a high temperature heat source for heating air, which has passed through the enthalpy heat exchanger, flowing in one of the first air passage or the second air passage, and a low temperature heat source for cooling air, which has passed through the enthalpy heat exchanger, flowing through the other of the first air passage or the second air passage; and a desiccant device undergoing moisture adsorption and desorption cycles by alternatingly contacting with air after contacting with the high temperature heat source to desorb moisture and with air before contacting with the low temperature heat source to adsorb moisture, wherein the heat pump device is provided with two heat medium paths which are switchable to enable one of the first air passage and the second air passage to contact to the high temperature heat source.

In such an apparatus, during a cooling operation, the first space becomes the indoor conditioning space with indoor air flowing through the first air passage and the second space becomes the outdoor space with outdoor air flowing through the second air passage. During a heating operation, the first space becomes the outdoor space with outdoor air flowing through the first air passage and the second space becomes the indoor space with indoor air flowing through the second air passage. A three-way valve is used to switch between cooling/heating operations so that a common path can be shared for both cooling and heating operations so that there is no need to provide a damper for re-directing the air flow, and the facility becomes more convenient to use.

In the above apparatus, the desiccant device may be in a shape of a rotor and may move between an adsorption path and a desorption path by rotating.

In the above apparatus, the first space is an indoor conditioning space and the second space is an outdoor space, and the first air passage contacts the high temperature heat source during a cooling operation, while the second air passage contacts the high temperature heat source during a heating operation.

The heat pump device may be a vapor compression type heat pump or an absorption type heat pump.

In the above apparatus, the desiccant device and heat exchangers in the heat pump device are housed in one assembly and the enthalpy heat exchanger is housed in a separate assembly. In such a apparatus, an enthalpy heat exchanger in an existing apparatus may be utilized to construct the air conditioning apparatus of the present design so that even an existing air conditioning apparatus may be converted to a more efficient apparatus at a reasonable cost.

In the apparatus presented above also, the ventilation air conditioning unit can be used in combination with a sensible heat conditioning unit (indoor air conditioning unit) which performs cooling on a sensible heat load in a conditioning space. In such a apparatus, during a cooling operation, outdoor air is led into the ventilation air conditioning unit so that the humidity ratio of the incoming air is lower than that of the air in the indoor conditioning space. Therefore, excess moisture is not brought into indoors, and indoor air conditioning unit does not need to dehumidify the incoming outdoor air. Temperature lift can be lowered and a significant energy saving can be achieved. Because there is no need to dehumidify, no drain is needed to remove condensate.

BEST MODE FOR CARRYING OUT THE INVENTION

Figure 1:
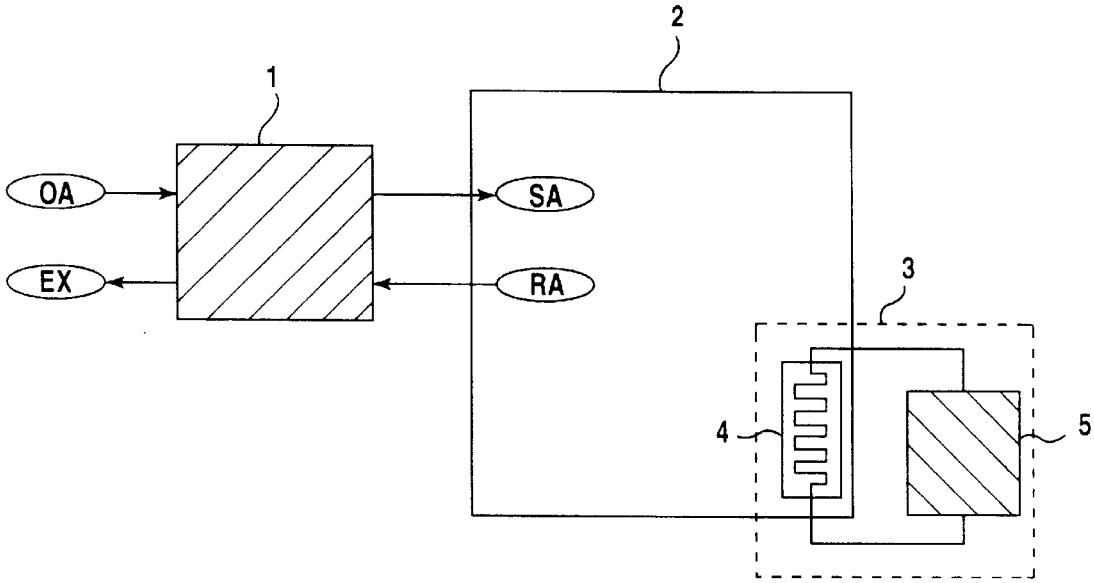
FIG. 1 is a schematic diagram of a basic arrangement of the air conditioning apparatus of the present invention.

In the following, a first embodiment will be presented with reference to FIGS. 1 to 4. FIG. 1 shows a basic configuration of the air conditioning apparatus, which is comprised by combining an indoor air conditioning unit 3 for processing air in an indoor space 2 (to be conditioned) while circulating it, and a ventilation air conditioning unit 1 to process outdoor air to introduce it into the indoor space 2. The indoor air conditioning unit 3 may be one of the usual ones which is operated by switching between cooling unit and a heating unit, but other types may also be employed.

Figure 2:
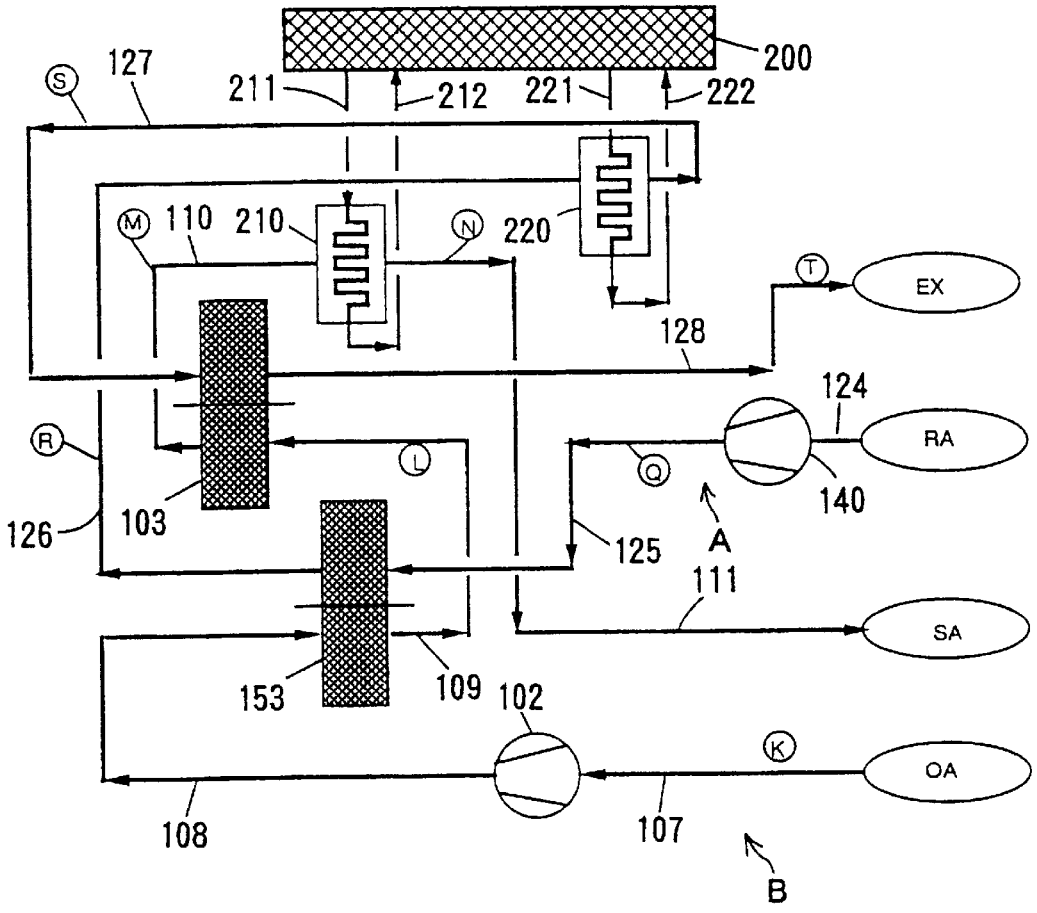
FIG. 2 is a schematic diagram of a basic arrangement of a first embodiment.

FIG. 2 shows air passages in the ventilation air conditioning unit 1 in the first embodiment. The ventilation air conditioning unit 1 is a desiccant assisted air conditioner that utilizes a desiccant wheel 103 which repeats cycles of moisture adsorption and desorption. In detail, the desiccant assisted conditioning unit 1 has an indoor air discharge path A (first air passage) for discharging spent indoor air to outdoors and an outdoor air admittance path B (second air passage) for admitting outdoor air into indoors and intersecting with the indoor air discharge path A. An enthalpy heat exchanger 153 and a desiccant wheel 103 are provided straddling between the indoor air discharge path A and the outdoor air admittance path B, as well as a heat pump device 200 to serve as a heat source for the desiccant assisted ventilation air conditioning unit 1. Heat pump device 200 may be any type of heat pumps, but in the present invention, a vapor compression type heat pump is used, which has been disclosed in a U.S patent application, Ser. No. 08/781,038 by the present inventor.

The indoor air discharge path A (first air passage) for discharging the indoor air to outside is comprised by connecting: the outlet opening (RA in FIG. 2) for the exhaust air from the indoor conditioning space (first space) to an intake opening of a blower 140 through a passage 124; the outlet opening of the blower 140 to the enthalpy heat exchanger 153 through a passage 125; the outlet opening of the enthalpy heat exchanger 153 in indoor air discharge path A to a heater (high temperature heat source) 220 of the heat pump device 200 through the passage 126; the outlet opening of a heater (high temperature heat source) 220 in the indoor air discharge path A is connected to the regeneration side of the desiccant wheel 103 through a passage 127; and the outlet opening on the regeneration side of the desiccant wheel 103 in the indoor air discharge path A is connected to the exhaust opening (EX in FIG. 2) to the outdoor space (a second space) through a passage 128. These passages constitute an air path for admitting and exhausting indoor air and exhausting the spent indoor air outside.

The outdoor air admittance path B is comprised by connecting: the outdoor space (second space) to the inlet opening of the blower 102 for admitting outdoor air through a passage 107; the discharge opening of the blower 102 to the enthalpy heat exchanger 153 through a passage 108; the outlet opening of the enthalpy heat exchanger 153 in the outdoor air admittance path B to the dehumidified air side (processed air) of the desiccant wheel 103 through a passage 109; the outlet opening on the dehumidified air side (processed air) of the desiccant wheel 103 in the outdoor air admittance path B to a cooler (low temperature heat source) 210 of the heat pump device 200 though a passage 110; and the outlet opening on the heat pump side in the outdoor air admittance path B to an air inlet opening (SA in FIG. 2) for the supply air to the indoor space (first space) through a passage 111. These passages constitute an air path for admitting outdoor air, processing outdoor air and admitting processed outdoor air into the conditioning space.

The inlet opening for a heating medium (hot water or refrigerant) for the heater 220 is connected to the heating medium outlet opening of the heat pump device 200 through a passage 221, and the hot water outlet opening for the heater 220 is connected to the heating medium inlet opening for the heat pump device 200 through a passage 222. Also, the cooling medium (chilled water or refrigerant)inlet opening for the cooler 210 is connected to the cooling medium outlet opening of the heat pump device 200 through a passage 211, and the chilled water outlet opening for the cooler 210 is connected to the cooling medium inlet opening of the heat pump device 200 through passage 212. The alphabetical references K~V shown inside the rackets correspond to those symbols showing the states of the air in FIG. 3, and SA stands for supply air (processed outdoor air), RA for return air (indoor air to be discharged), OA to outdoor air and EX to exhaust air.

Next, the cooling operation of the desiccant assisted ventilation air conditioning apparatus presented above will be explained with reference to a psychrometric chart shown in FIG. 3 relating to the air conditioning action in the second embodiment shown in FIG. 2.

Return air (RA: state Q) from the indoor space in the indoor air discharge path A is drawn by the blower 140 through the passage 124, is pressurized and delivered to the enthalpy heat exchanger 153 where it undergoes heat exchange with return air (state K) and follows along a straight line, joining state K and state Q, in accord with the known behavior of such enthalpy heat exchanger, so that its enthalpy is increased and its temperature and humidity ratio are raised (state R). Return air from the enthalpy heat exchanger 153 is sent to the heater (high temperature heat source) 220 of the heat pump device 200 to be heated to about 45~60° C. so that its relative humidity is decreased (state S). Return air having a lowered relative humidity flows into the regeneration side of the desiccant wheel 103 and desorbs moisture in the desiccant material (post desorption air: state T). The return air passes through the desiccant wheel 103 and is discarded to outdoors through the passage 123.

Outdoor air (OA: state K) admitted through the outdoor air admittance path A is drawn by the blower 102 through the passage 107, is pressurized and is delivered to the enthalpy heat exchanger 153, through the passage 108, where it undergoes enthalpy exchange with return air (state Q) and follows along straight line, joining state K and state Q, in accord with he known behavior of such enthalpy heat exchanger, so that its enthalpy is decreased and its temperature and humidity ratio are lowered (state L). Dehumidified and cooled supply air having decreased enthalpy (state L) flows into the desiccant wheel 103 through the passage 109, and its moisture is adsorbed through an isenthalpic process by the desiccant material, and its humidity ratio is lowered (state M). The supply air with a lowered humidity enters into the cooler (low temperature heat source) of the heat pump 200, and is cooled to about 15~20° C. (state N). The cooled supply air is admitted into the indoor space through the passage 111.

The supply air thus obtained (SA: state N) has lower enthalpy and lower humidity ratio than the air in the indoor space. That is, it is possible to generate an enthalpy difference $\Delta h$ and an humidity ratio difference $\Delta x$ between the supply air (OA: state N) and the indoor air (state Q). This means that excess moisture is not brought into the indoor space and cooling is effected by the enthalpy difference.

The operation of the heat pump device 200 in the desiccant assisted air conditioning system will be explained. The cooler 210 of the heat pump device 200 cools supply air to lower enthalpy by removing sensible heat. The heater 220 heats the return air to lower its relative humidity so as to effect desorbing of the desiccant material of the desiccant wheel 103. This desorption action regenerates the dehumidifying ability of the desiccant material, and causes the return air exhausted from the indoor space at a state Q to be dehumidified to a state M, and coupled with the sensible heat removal, produces a change so that the supply air (state N) has a lower enthalpy and humidity than the indoor air (state Q). The action of the heat pump device 200 to cool the supply air and the use of the removed heat to regenerate the desiccant material produce a significant energy conservation in operating the apparatus, compared with a system requiring a separate cooling source and a heating source.

The present heat pump device is able to process the entire conditioning load of the outdoor supply air by using the heat pump device having a cooling capacity to process the amount of heat equal to a product of the air flowrate and the enthalpy difference between the states M and N. The conventional systems not having the present conditioning unit 1 must have a refrigeration unit having a sufficient cooling capacity to process the equivalent amount of heat (enthalpy difference between states K and N multiplied by the flowrate of the air), therefore, it is obvious that the present system provides a significant comparative advantage in energy conservation.

Suppose the apparatus is designed to achieve a state N (supply air) to equal state Q (indoor air), and if an enthalpy heat exchange efficiency of 70% is assumed, a segment LM becomes parallel to an isenthalpic line. Therefore, an enthalpy value at a point M can be substituted with an enthalpy value at a point L, so that enthalpy difference M→N can substituted for enthalpy difference L→Q and enthalpy difference K→N can substituted for enthalpy difference K→Q. Therefore, enthalpy difference (K→N):enthalpy difference (M→N)=enthalpy difference (K→Q):enthalpy difference (L→Q)=10:3

In other words, the cooling capacity of the present ventilation air conditioning device needs to be only 3/10 of a conventional system not having the ventilation air conditioning unit 1, thus the present system provides a 70% energy saving.

Further savings are obtained in the indoor air conditioning unit 3. That is, the desiccant assisted ventilation air conditioning unit 1 lowers the humidity ratio of supply air SA than that of the return air RA so that excess outside moisture is not brought into the indoor space. Therefore, the conditioning unit 3 does not need to dehumidify the supply air, and only the sensible heat of indoor air need to be lowered. Therefore, conditioning unit 3 only needs to cool indoor air to about 20° C. so that the evaporator temperature needs to be about 10° C. higher than conventional. Accordingly, the temperature lift can be reduced (for example from 40° C. to 30° C.). Energy saving is this case is:

$$\Delta T_1/\Delta T_2=30/40=0.75$$

representing an energy saving of about 25%.

Therefore, the overall saving in the system energy consumption can be estimated, by considering that the proportion of the outdoor air load in an average air conditioning system is about 30%, $$0.3\times0.3+0.7\times0.75=0.615$$

representing about 38% energy saving.

In addition, the unit 3 no longer needs to dehumidify so that drains are not required, leading to lowering in system cost and simpler operation. In the present system, a vapor compression type heat pump was used as the heat pump device 200, but the foregoing functions can be provided by other types heat source that can act as a heat pump. For example, an absorption type heat pump disclosed in a U.S. patent application, Ser. No. 08/769,253 may be used to obtain the same effects. Also, heat transfer medium in the present system is hot/chilled water, but heat of condensation and vaporization of a refrigerant may also be utilized.

Also, to avoid transmitting noise and vibration of the vapor compression type heat pump to indoor space, a collective assembly containing the desiccant and the heat exchanger of the heat pump device may be separated from the other collective assembly containing the compressor of the heat pump, as disclosed in a Japanese Patent Application, H8-195732.

Also, the above discussion is related to the cooling operation of the apparatus, but when the apparatus is used for heating, the state of the indoor space and the state of the outdoor air are interchanged, so that the outdoor air is low temperature, low humidity and the indoor air becomes high temperature, high humidity. Therefore, if indoor heating is required, the first passage is used for outdoor air inlet path and the second passage is used for return air discharge path for the exhaust air (spent air) so that the supply air to the indoor space is at a state T and the discharge air is at a state N, so that moisture in the outdoor air is recovered to be added to humidify the indoor air, thereby lowering the heating load on the indoor air conditioning unit 3. The operation of the system in this case is the same as for cooling operation, and explanations are omitted.

Figure 4:
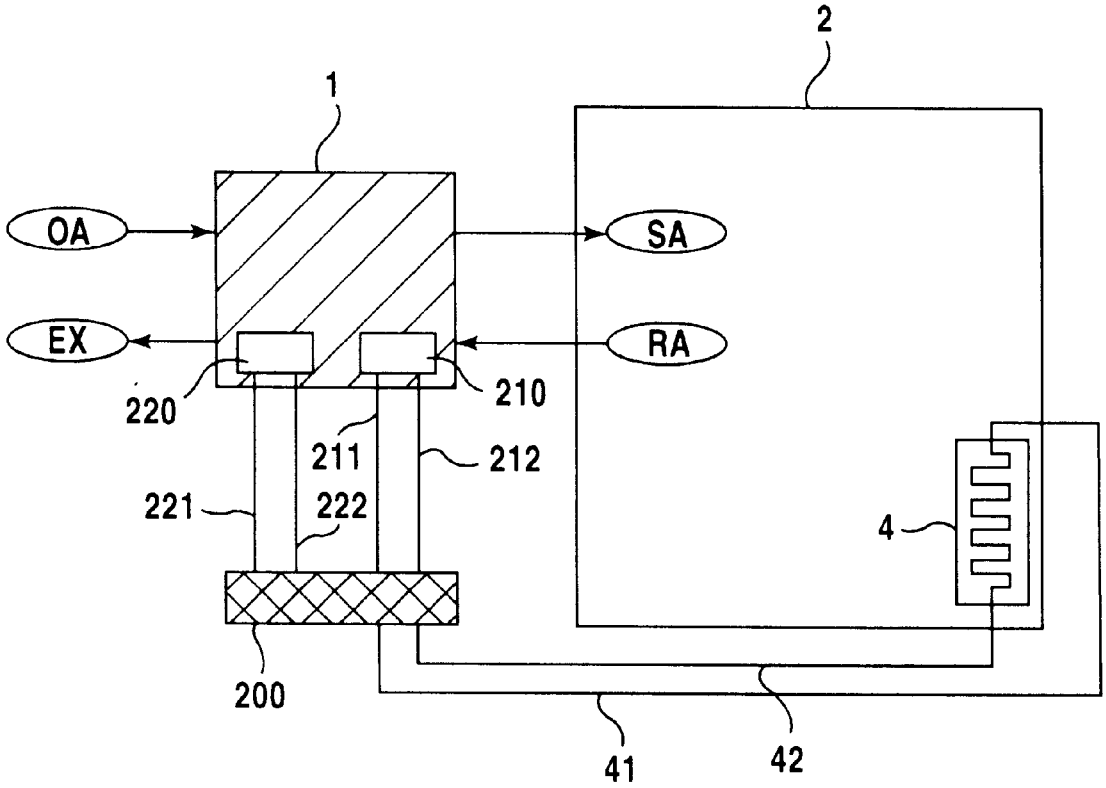
FIG. 4 is a schematic diagram of a basic arrangement of a second embodiment of the air conditioning apparatus of the present invention.

FIG. 4 is a schematic diagram of a second embodiment related to the ventilation air conditioning apparatus. The heat pump 200 connected to the ventilation air conditioning unit 1 is connected through the passages 41, 42 to the indoor conditioning unit (sensible heat processor) 4 located in the indoor space. In the present system, the heat pump device 200 of the ventilation air conditioning unit 1 serves also as a heat source for the conditioning unit 4, so that the sensible heat recovered in the indoor space is raised to provide heat to the heat pump device 200. This increases the amount of heat available to desorb the desiccant material, and the desorption efficiency of desiccant regeneration process is improved, so that the humidity in the supply air is reduced and the processing capacity for the sensible heat load and ultimately for the cooling load is increased. The power consumption in the heat pump device 200 is thus restrained to improve the energy conservation.

Next, an operation of the air conditioning system according to a third embodiment will be explained with reference to FIGS. 5 and 6. The present system is of the same type as shown in FIG. 1, and comprised of a combination of indoor air conditioning unit 3 for circulating and processing the air in the indoor space, and a ventilation air conditioning unit 1 for processing outdoor air. The indoor conditioning unit 3 can be a usual type that is operated by switching between a cooling operation and heating operation, but other types are also applicable.

Figure 5:
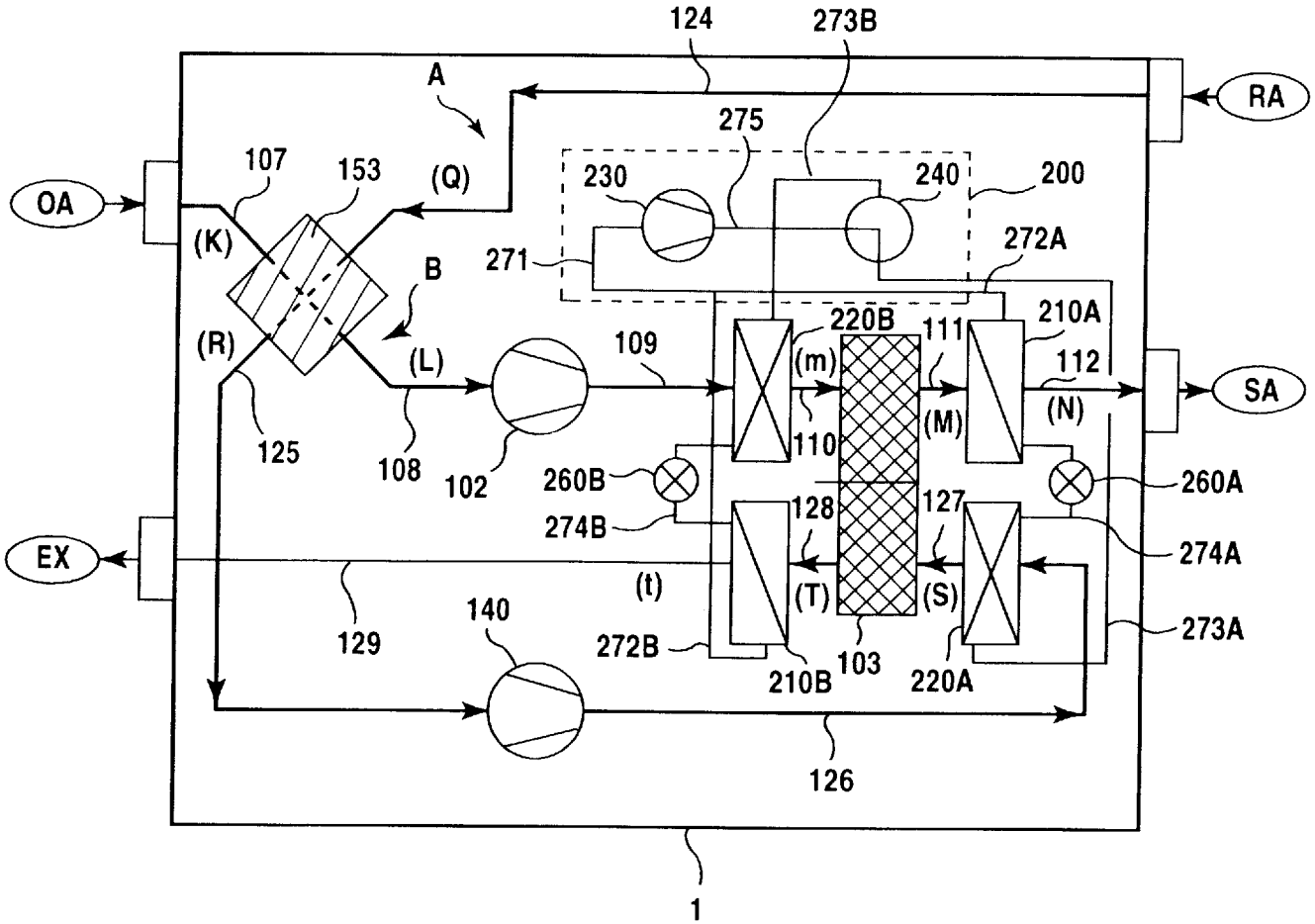
FIG. 5 is a schematic diagram of a basic arrangement of a third embodiment of the air conditioning apparatus of the present invention.
Figure 6:
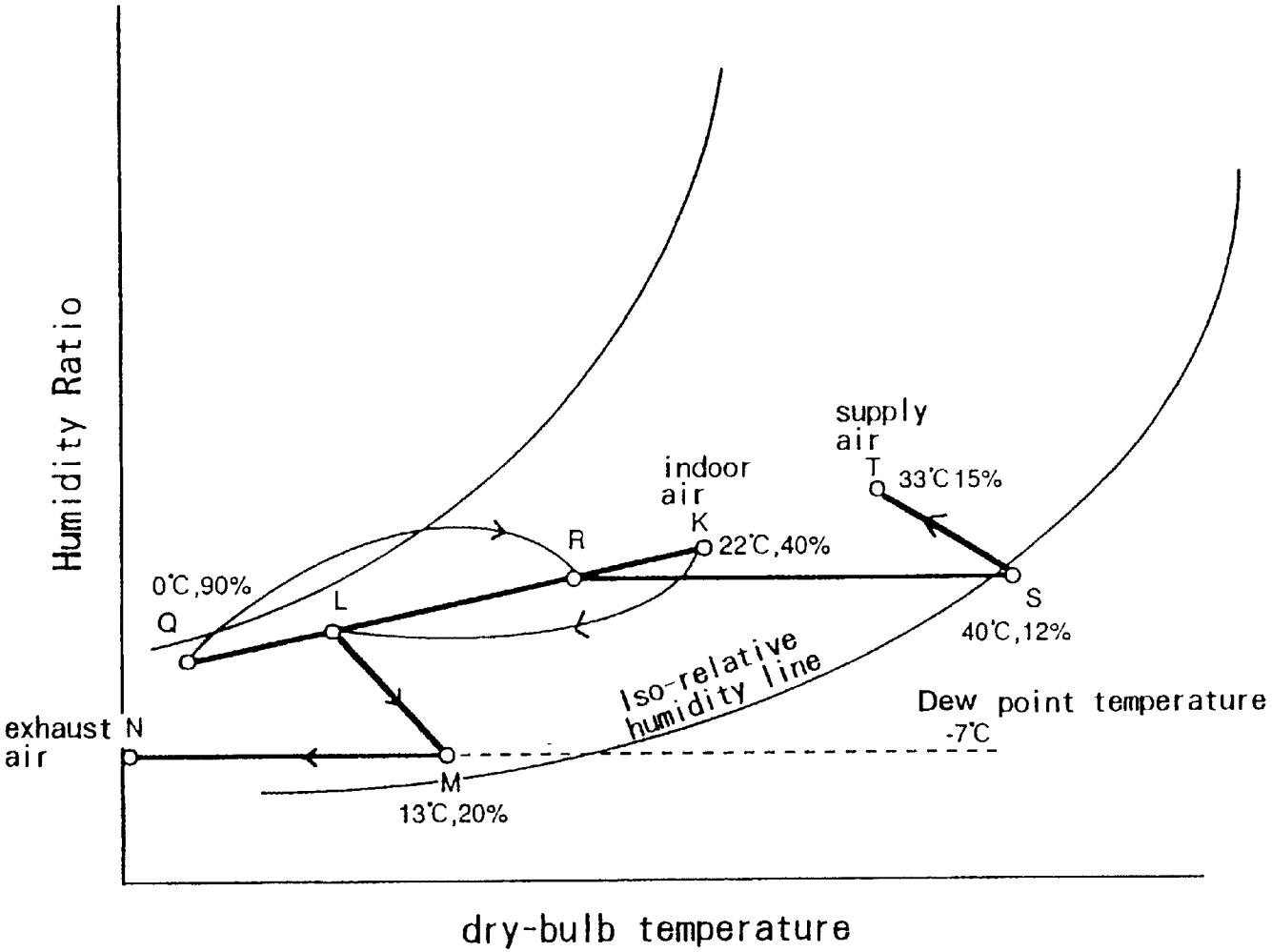
FIG. 6 is a psychrometric chart for explaining the desiccant conditioning cycle in an air conditioning apparatus shown in FIG. 5.

FIG. 5 shows another configuration of the ventilation air conditioning unit 1 of a third embodiment of the air conditioning system shown in FIG. 1. The ventilation air conditioning unit 1 is a desiccant assisted ventilation air conditioner that utilizes a desiccant wheel 103 which repeats adsorbing and desorbing (regeneration) cycles, and includes an enthalpy heat exchanger 153 and a heat pump device 200. In detail, the desiccant assisted ventilation air conditioning unit 1 has an indoor air discharge path A (first air passage) for discharging indoor air to outdoors and an intersecting outdoor air admittance path B (second air passage) for admitting outdoor air into indoors. An enthalpy heat exchanger 153 and a desiccant wheel 103 are provided to straddle the indoor air discharge path A and the outdoor air admittance path B, as well as a heat pump device 200 to serve as a heat source for the desiccant assisted ventilation air conditioning unit 1. Heat pump device 200 may be any type, but in the present invention, a vapor compression type heat pump is used, which has been disclosed in a U.S. patent application, Ser. No. 08/781,038 by the present inventor.

The indoor air discharge path A (first air passage) for discharging the indoor air to outside is comprised by connecting: the outlet opening (RA in FIG. 5) of the indoor space (first space) and the enthalpy heat exchanger 153 through a passage 124; the outlet opening of the enthalpy heat exchanger 153 to the blower 140 through a passage 125; the outlet opening of the blower 140 in indoor air discharge path A to a first high temperature heat source heat exchanger (heater) 220A through the passage 126; the outlet opening of the first high temperature heat source heat exchanger 220A in the indoor air discharge path A to the desiccant wheel 103 through a passage 127; and the outlet opening on the desiccant wheel 103 in the indoor air discharge path A to a second low temperature heat source heat exchanger (cooler) 210B of the heat pump device 200 through a passage 128; the outlet opening of the second low temperature heat source heat exchanger 210B in the indoor air discharge path A to the exhaust opening (EX in FIG. 5) for discharging the spent air in the outdoor space (second space) through a passage 129. These passages constitute an air path for admitting indoor air and exhausting spent indoor air outside.

The outdoor air admittance path B is comprised by connecting: the inlet opening (OA in FIG. 5) for the outdoor space (second space) to the enthalpy heat exchanger 153 through a passage 107; the outlet opening of the enthalpy heat exchanger 153 to outdoor air admittance blower 102 through a passage 108; the outlet opening of the blower 102 to a second high temperature heat source heat exchanger (heater) 220B through a passage 100; the second high temperature source heat exchanger 220B in the admittance path B to the desiccant wheel 103 though a passage 110; the outlet opening of the desiccant wheel 103 in the admittance path B to the first low temperature heat exchanger (cooler) 210A of the heat pump device 200 through a passage 111; the outlet opening of the first low temperature heat source heat exchanger (cooler) 210A in the admittance path B to the inlet opening (SA in FIG. 5) to the indoor space (first space) through a passage 112. These passages constitute an air path for admitting outdoor air, processing outdoor air and admitting processed outdoor air into the indoor space.

The heat pump device 200 is comprised by: a compressor 230; a first low temperature heat source heat exchanger 210A; a first high temperature heat source heat exchanger 220A; a second low temper source heat exchanger 210B; a second high temperature heat source heat exchanger 220B; a reversible three-way valve 240 for switching between cooling/heating operations; an expansion valve 260A for cooling operation; an expansion valve 260B for heating operation; and cooling medium passages 271~275. During the cooling operation, the three-way valve 240 is switched so as to connect the passages 273A and 275, as shown in FIG. 5, so that the first low temperature heat source heat exchanger 210A and the first high temperature heat source heat exchanger 220A are operated. And during the heating operation, the three-way valve 240 is switched so as to connect the passages 273B and 275 so that the second low temperature heat source heat exchanger 210B and the second high temperature heat source heat exchanger 220B are operated. The alphabetical references K~V shown inside the brackets in FIG. 5 correspond to those symbols to show the state of the air in FIG. 3, and SA stands for supply air (processed outdoor air), RA for return air (indoor air to be discharged), OA to outdoor air and EX to exhaust air.

Figure 3:
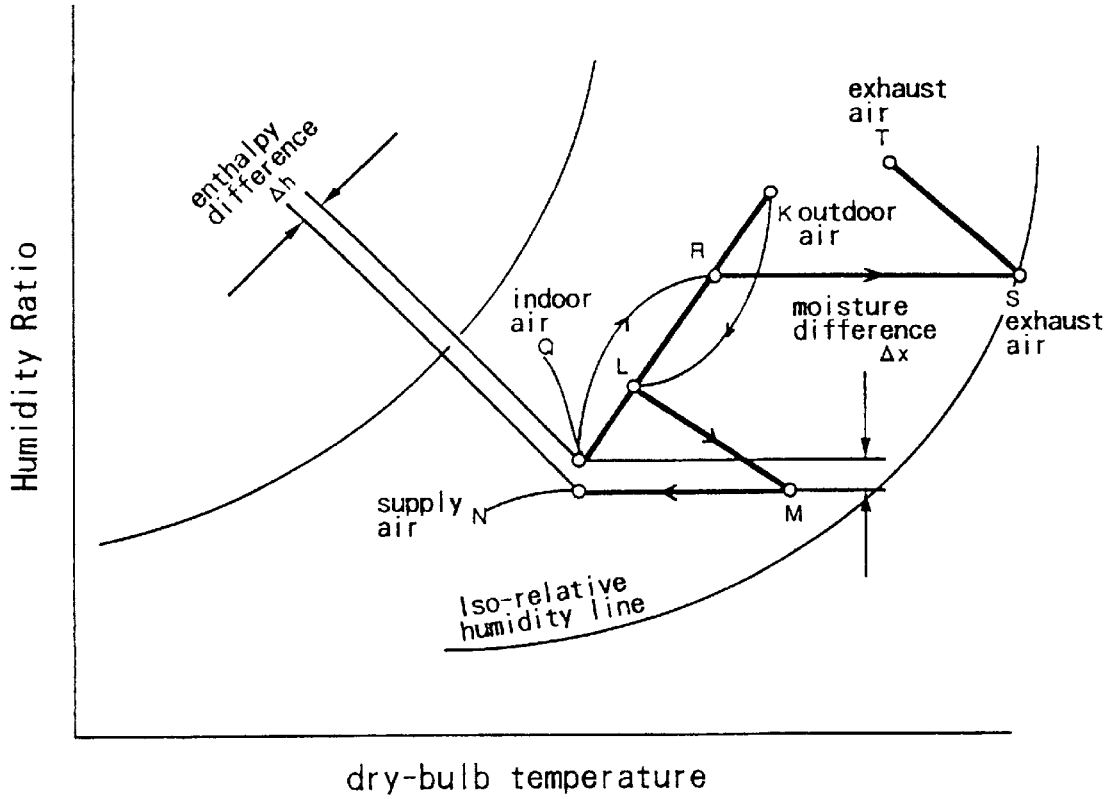
FIG. 3 is a psychrometric chart for explaining the desiccant assisted air conditioning cycle.

The operation of the third embodiment system for cooling can be explained in the same way as in the system shown in FIG. 2, by referring to FIG. 3.

Return air (RA: state Q) from the indoor space is drawn through the passage 124 to the enthalpy heat exchanger 153 where it undergoes heat exchange with return air (state K) and follows along a straight line, joining state K and state Q, in accord with the known behavior of such enthalpy heat exchanger, so that its enthalpy is increased and its temperature and humidity ratio are raised (state R). Return air from the enthalpy heat exchanger 153 is drawn by the blower 140 to be pressurized and delivered to first high temperature heat source heat exchanger (heater) 220A of the heat pump device 200 to be heated to about 45~60° C. so that its relative humidity is decreased (state S). Return air having a lowered relative humidity flows into the regeneration side of the desiccant wheel 103 and desorbs moisture in the desiccant material (post desorption air: state T). The return air after passes through the desiccant wheel 103 is sent to second low temperature heat source heat exchanger (heater) 210B through the passage 128, but during the cooling operation, the three-way valve is positioned to deactivate the heat exchange so that it passes through without changing its temperature, and is discarded to outdoors through the passage 129.

Outdoor air (OA: state K) admitted through the outdoor air admittance path A is drawn through the passage 107 to the enthalpy heat exchanger 153, where it undergoes heat exchange with return air (state Q) and follows along a straight line, joining state K and state Q, in accord with the known behavior of such enthalpy heat exchanger, so that its enthalpy is decreased and its temperature and humidity ratio are lowered (state L). Dehumidified and cooled supply air having decreased enthalpy (state L) is drawn into the blower 102, through the passage 108, is pressurized and is sent to the second high temperature heat source heat exchanger (heater) 220B. However, during the heating operation, the three-way valve is positioned to deactivate the heat exchange so that supply air passes through without changing its temperature. Supply air further flows into the desiccant wheel 103 through the passage 109, and its moisture is adsorbed through an isenthalpic process by the desiccant material, and its humidity ratio is lowered (state M). The supply air with a lowered humidity enters into the first low temperature heat source heat exchanger (cooler) 210A of the heat pump device 200, and is cooled to about 15~20° C. (state N). The cooled supply air is admitted into the indoor space through the passage 112.

The supply air thus obtained (SA: state N) has lower enthalpy and lower humidity ratio than the air in the indoor space. That is, it is possible to generate an enthalpy difference $\Delta h$ and an humidity ratio difference $\Delta x$ between the supply air (OA: state N) and the indoor air (state Q). This means that excess moisture is not brought into the indoor space and cooling is effected by the enthalpy difference.

The operation and energy saving effect of the heat pump device 200 in the desiccant assisted air conditioning system during cooling operation can be explained in the same way as that of the embodiment shown in FIG. 2, and the explanation will be omitted.

For the heating operation, the state of the indoor space and the state of the outdoor air are interchanged, so that the outdoor air is low temperature, low humidity and the indoor air becomes high temperature, high humidity. Therefore, if room heating is required, the outdoor air is used as regeneration air and indoor air is used as process air. The heating operation in winter is explained with reference to a psychrometric chart shown in FIG. 6. In this case, a general condition is selected so that the indoor conditions are dry-bulb temperature at 22° C., a relative humidity at 40%, and outdoor conditions are assumed to be snowing, dry bulb temperature at 0° C. and a relative humidity at 90%. The alphabetical references K~Q in FIG. 6 are used so as to relate to cooling operation and apply only to FIG. 6, and mean differently than those shown in FIG. 5.

Return air (RA: state K) from indoor space in the indoor air discharge path A is delivered to the enthalpy heat exchanger 153 through the passage 124, where it undergoes an enthalpy heat exchange with outdoor air (state Q) and follows along a straight line, joining state K and state Q, in accord with the known behavior of such enthalpy heat exchanger, to decrease its enthalpy so that its temperature and humidity ratio are decreased (state L). Return air from the enthalpy heat exchanger 153 is drawn into the blower 140, is pressurized and is sent to the first high temperature heat source heat exchanger (heater) 220A of the heat pump device 200. During the heating operation, the three-way valve is switched to stop the heat exchanger operation, so that the air passes through without transferring any heat, and flows into the desiccant wheel 103 to adsorb moisture in an isenthalpic process, and its humidity ratio is reduced (state M). Return air which has passed through the desiccant wheel 103 is sent to the second low temperature heat source heat exchanger (cooler) 210B through the passage 128, and is cooled to a temperature lower than 0° C. (state N). The cooled return air is discarded outdoors as spent air through the passage 129. In this process, the return air (state N) is in contact with the second low temperature heat source heat exchanger (cooler) 210B serving as the low temperature heat source for the heat pump device 200. In the process of changing from state L to M, the humidity ratio in the return air decreases and its dew point is lowered such as to prevent frosting on the heat exchanging surfaces of the cooler 210B. Even when the relative humidity in the return air, in a state Q, rises to 80~90% in case of snowing, the dew point can be lowered to less than −7° C. and the temperature of the return air in a state M can be raised 10° C. higher than the outdoor temperature. This means that the operation of the heat pump can be continued without having to defrost, even when the effective temperature difference for heat recovery in the heat pump device is set as high as 17° C.

In the meantime, outdoor air (OA: state Q) is delivered to the enthalpy heat exchanger 153, through the passage 107, where it undergoes a total heat exchange with return air (state K) and follows along a straight line, joining state K and state Q, in accord with the known behavior of such enthalpy heat exchanger, to increase its enthalpy so that its temperature and humidity ratio are increased (state R). The humidified and heated outdoor air having a raised enthalpy (state R) is drawn into the blower 102, through the passage 108, is pressurized and is sent to the second high temperature heat source heat exchanger (heater) 220B, through the passage 109, and reaches a temperature of about 40°~50° C. in the first high temperature heat source heat exchanger (heater) 220A to lower its relative humidity (state S). The outdoor air having a lowered humidity enters into the desiccant wheel 103 to desorb the moisture (post regeneration air: state T). The outdoor air exiting the desiccant wheel 103 is sent to the first low temperature heat source heat exchanger (cooler) 210A through the passage 111, but during the heating operation, the three-way valve is positioned to deactivate the heat exchanger so that it passes through without changing its temperature, and is blown into the indoor space through the passage 112 as supply air SA. Supply air thus obtained is in a state T, and its enthalpy and humidity ratio can be higher than those in the indoor space. In other words, it is possible to generate differences in enthalpy and humidity ratio between the supply air (state T) and the indoor air (state K), so as to extract humidity from the outdoor air and humidify the supply air to the indoor space, and to provide heat to the indoor space through the enthalpy difference.

The operation of the heat pump device 200 in the desiccant assisted ventilation air conditioner will be explained. In the second low temperature heat source heat exchanger 210B of the heat pump device, the return air is cooled so that its sensible heat can be recovered, and in the second high temperature heat source heat exchanger 220B, outdoor supply air is heated to lower its relative humidity so that it can be used to desorb moisture from the desiccant material in the desiccant wheel 103. This regeneration process regenerates the adsorption ability, and the supply air is dehumidified in the enthalpy heat exchanger from state L to state M so that the humidity ratio of the return air is lowered as well as its dew point. As discussed before, even when the effective temperature difference is selected to be as high as 17° C. to recover as much heat as possible, no defrosting is required to continue the heating operation.

If the heat is insufficient in the high temperature heat source heat exchangers 210A, 210B to sufficiently warm up the incoming outdoor air, auxiliary heating devices such as a bypass path for hot gas or additional electric heaters may be used.

In these embodiments, switching between cooling/heating operations is performed selectively with one blower through a three-way valve 240, but separate compressors for cooling and heating operations may be used to construct separate heat pump cycles.

According to such a system of air conditioning, the first low temperature heat source heat exchanger and the first high temperature heat source heat exchanger in the heat pump device are activated during the cooling operation, and the second low temperature heat source heat exchanger and the second high temperature heat source heat exchanger in the heat pump device are used during the heating operation. Such a system is operated by switches and does not require rerouting dampers.

Figure 7:
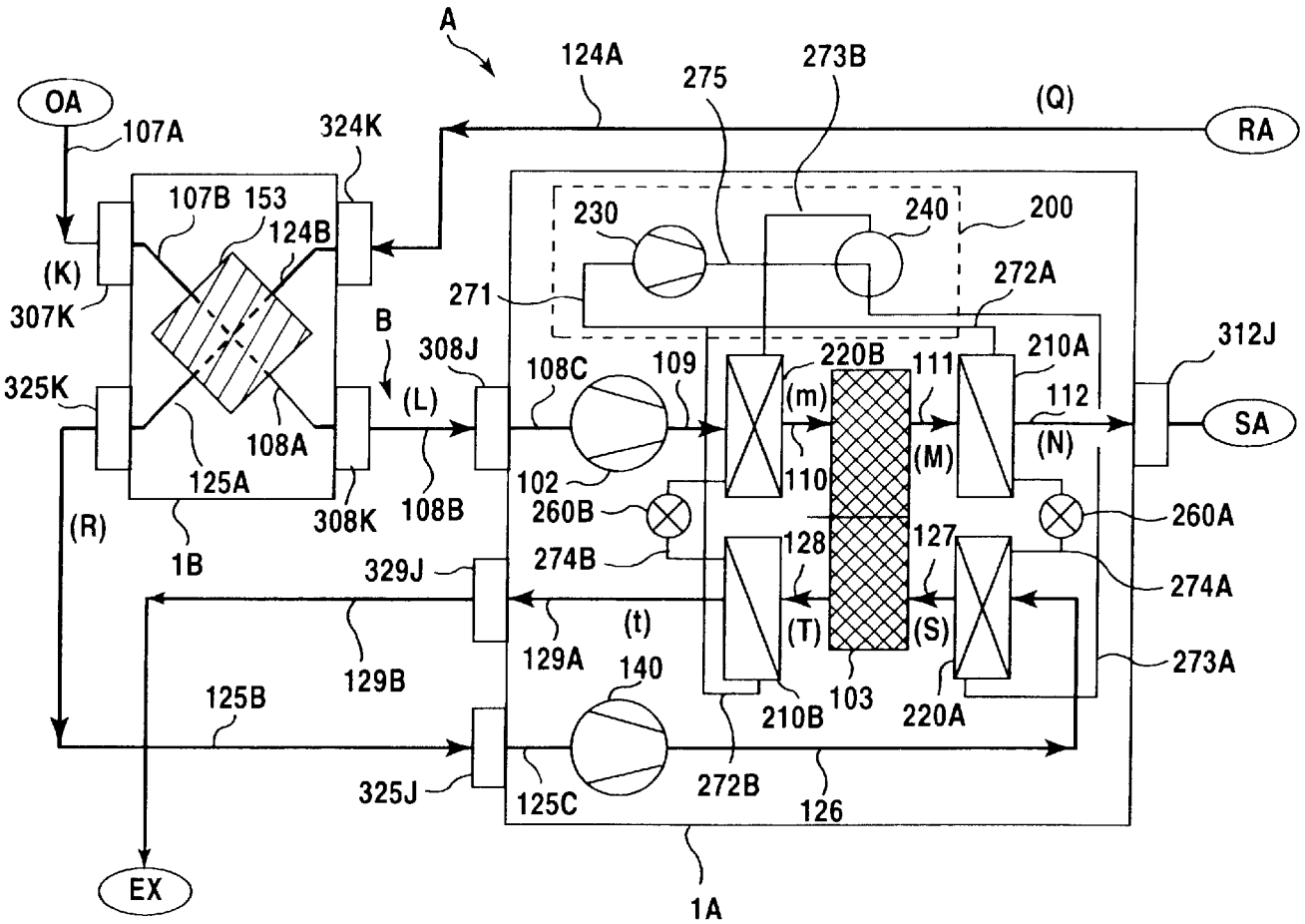
FIG. 7 is a schematic diagram of a basic arrangement of a fourth embodiment of the air conditioning system of the present invention.
Figure 8:
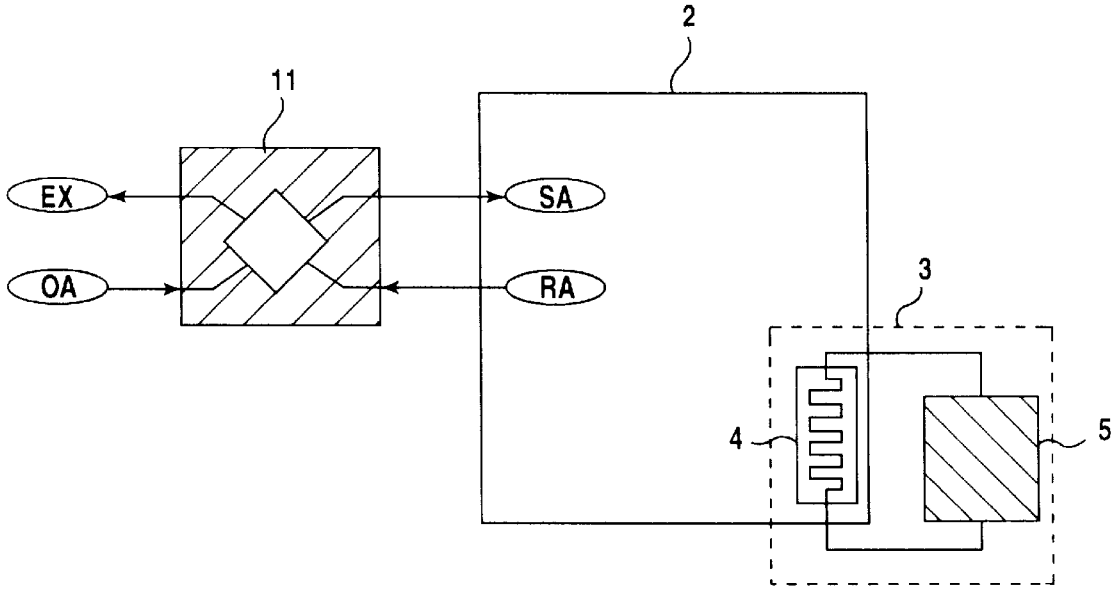
FIG.8 PRIOR ART
FIG. 8 is a schematic diagram of a basic arrangement in a conventional air conditioning system.
Figure 9:
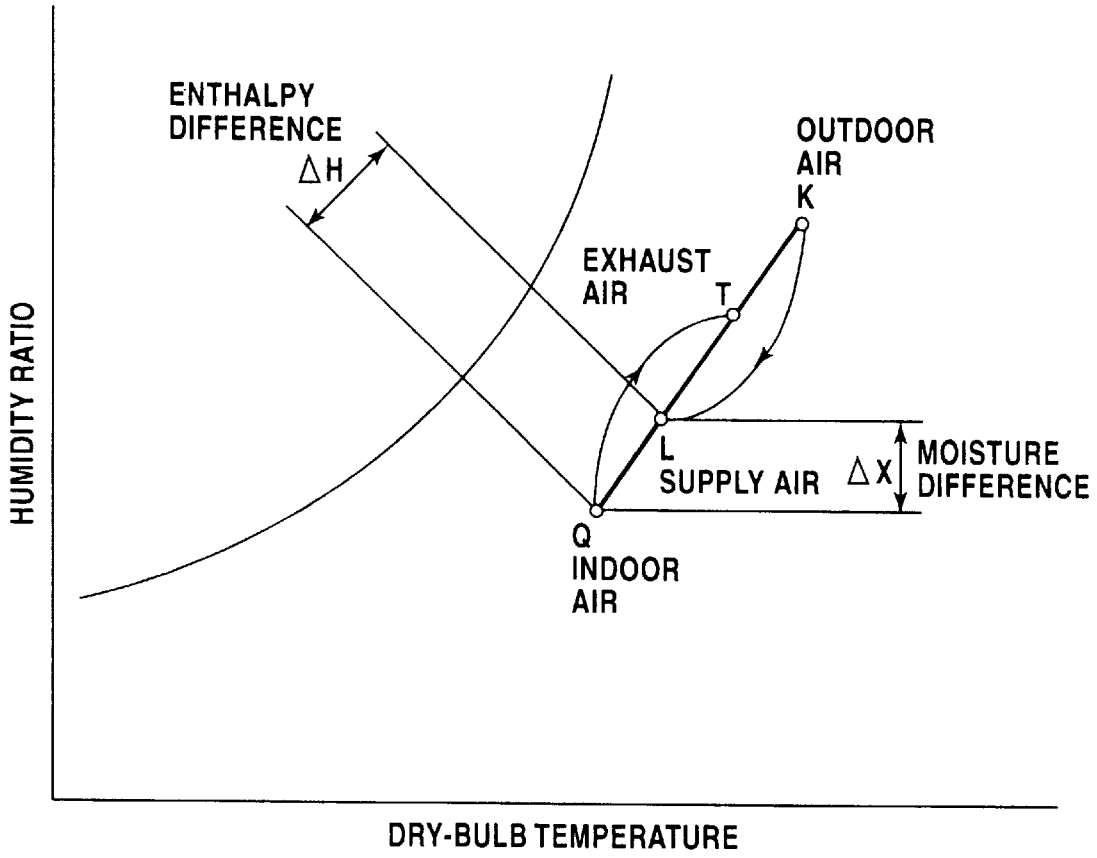
Fig.9 PRIOR ART
FIG. 9 is a psychrometric chart for explaining the desiccant conditioning cycle in a conventional air conditioning system.

FIG. 7 is a schematic diagram of a fourth embodiment of the air conditioning system. The system is comprised by collective assemblies 1A and 1B connected with duct passages 108B and 125B, in which the assembly 1A houses at least a desiccant 103, a first low temperature heat source heat exchanger 210A, a first high temperature heat source heat exchanger 220A and a second low temperature heat source heat exchanger 210B and a second high temperature heat source heat exchanger 220B; and the assembly 1B houses an enthalpy heat exchanger 153. With reference to FIG. 5, the passage 107 in FIG. 5 is comprised by passages 107A, 107B in FIG. 7; the passage 108 in FIG. 5 is comprised by passages 108A, 108B; the passage 124 in FIG. 5 is comprised by passages 124A, 124B in FIG. 7; and the passage 125 in FIG. 5 is comprised by passages 125A, 125B and 125C. The assemblies 1A, 1B are joined through joint openings 308J, 308K, 325J and 325K provided at the joint sections. This arrangement has an advantage that the air conditioning systems described above may be constructed by combining an assembly 1B comprising a conventionally available enthalpy heat exchanger unit, with an assembly 1A constructed as specified above. This approach enables to reduce the cost of implementing the present system by utilizing an existing air conditioning structure. The operation of this system is the same as that explained under the third embodiment, and the explanation will be omitted.

INDUSTRIAL APPLICABILITY

The present invention is suitable for use as an air conditioning apparatus in usual residential buildings or larger buildings for use as super market stores, offices or facilities for public use or the like.

What is claimed is:

1. An air conditioning apparatus comprising:

a first air passage for directing air from a first space to a second space, and a second air passage for directing air from said second space to said first space;

a desiccant device alternatingly communicating with said first air passage and with said second air passage so as to perform a regeneration process in said first air passage and to perform a dehumidification process in said second air passage;

a heat pump device having a high temperature heat source for heating air flowing through said first air passage and a low temperature heat source for cooling air flowing through said second air passage; and an enthalpy heat exchanger for performing enthalpy heat exchange between air in said first and second air passages;

wherein, air flowing in said first air passage exchanges enthalpy in said enthalpy heat exchanger with air flowing in said second air passage, is then heated by contacting said high temperature heat source, and flows into said desiccant device so as to desorb and regenerate said desiccant device and flows into said second space, and wherein, air flowing in said second air passage exchanges enthalpy in said enthalpy heat exchanger with air flowing in said first air passage, is then dehumidified by passing through said desiccant device, is cooled by contacting said low temperature heat source and flows into said first space.

2. An apparatus according to claim 1, wherein said heat pump device comprises a vapor compression type heat pump.

3. An apparatus according to claim 1, wherein said heat pump device comprises an absorption type heat pump.

4. An apparatus according to claim 1, wherein, during a cooling operation, said first space is an indoor conditioning space and said second space is an outdoor space.

5. An apparatus according to claim 1, wherein, during a heating operation, said first space is an outdoor space and said second space is an indoor conditioning space.

6. An apparatus according to claim 1, wherein said heat pump device performs cooling on a sensible heat load in a conditioning space.

7. An air conditioning system comprising a first air conditioning apparatus for processing and admitting an outdoor air into an indoor space and a second air conditioning apparatus for processing a sensible heat load, wherein said first air conditioning apparatus comprising:

a first air passage for directing air from a first space to a second space, and a second air passage for directing air from said second space to said first space;

a desiccant device alternatingly communicating with said first air passage and with said second air passage so as to perform a regeneration process in said first air passage and to perform a dehumidification process in said second air passage;

a heat pump device having a high temperature heat source for heating air flowing through said first air passage and a low temperature heat source for cooling air flowing through said second air passage; and an enthalpy heat exchanger for performing enthalpy heat exchange between air in said first and second air passages;

wherein, air flowing in said first air passage exchanges heat in said enthalpy heat exchanger with air flowing in said second air passage, is then heated by contacting said high temperature heat source, and flows into said desiccant device so as to desorb and regenerate said desiccant device and flows into said second space, and wherein, air flowing in said second air passage exchanges enthalpy in said enthalpy heat exchanger with air flowing in said first air passage, is then dehumidified by passing through said desiccant device, is cooled by contacting said low temperature heat source and flows into said first space.

8. An air conditioning apparatus comprising:

a first air passage for directing air from a first space to a second, and a second air passage for directing air from said second space to said first space;

an enthalpy heat exchanger for exchanging enthalpy between air flowing in said first air passage and air flowing in said second air passage;

a heat pump device having a high temperature heat source for heating air, which has passed through said enthalpy heat exchanger, flowing in one of said first air passage or said second air passage, and a low temperature heat source for cooling air, which has passed through said enthalpy heat exchanger, flowing through the other of said first air passage or said second air passage; and a desiccant device undergoing moisture adsorption and desorption cycles by alternatingly contacting with air after contacting with said high temperature heat source to desorb moisture and with air before contacting with said low temperature heat source to adsorb moisture, wherein said heat pump device is provided with two heat medium paths which are switchable to enable one of said first air passage and said second air passage to contact to said high temperature heat source.

9. An apparatus according to claim 8, wherein said desiccant device comprises a wheel rotatable between an adsorption path and a desorption path.

10. An apparatus according to claim 8, wherein said first space is an indoor conditioning space and said second space is an outdoor space.

11. An apparatus according to claim 8, wherein said desiccant device and heat exchangers in said heat pump device are housed in one assembly and said enthalpy heat exchanger is housed in a separate assembly.

12. An apparatus according to claim 8, wherein said heat pump device comprises a vapor compression type heat pump.

13. An apparatus according to claim 8, wherein said heat pump device comprises an absorption type heat pump.

14. An air conditioning system comprising a first air conditioning apparatus for processing and admitting an outdoor air into an indoor space and a second air conditioning apparatus for processing a sensible heat load, wherein said first air conditioning apparatus comprising:

a first air passage for directing air from a first space to a second, and a second air passage for directing air from said second space to said first space;

an enthalpy heat exchanger for exchanging enthalpy between air flowing in said first air passage and air flowing in said second air passage;

a heat pump device having a high temperature heat source for heating air, which has passed through said enthalpy heat exchanger, flowing in one of said first air passage or said second air passage, and a low temperature heat source for cooling air, which has passed through said enthalpy heat exchanger, flowing through the other of said first air passage or said second air passage; and a desiccant device undergoing moisture adsorption and desorption cycles by alternatingly contacting with air after contacting with said high temperature heat source to desorb moisture and with air before contacting with said low temperature heat source to adsorb moisture, wherein said heat pump device is provided with two heat medium paths which are switchable to enable one of said first air passage and said second air passage to contact to said high temperature heat source.

* * * * *